US007472986B2

(12) United States Patent
Hori

(10) Patent No.: US 7,472,986 B2
(45) Date of Patent: Jan. 6, 2009

(54) LIQUID DROPLET DISCHARGE HEAD AND LIQUID DROPLET DISCHARGE DEVICE

(75) Inventor: Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 220 days.

(21) Appl. No.: 11/092,779

(22) Filed: Mar. 30, 2005

(65) Prior Publication Data

US 2005/0219315 A1 Oct. 6, 2005

(30) Foreign Application Priority Data

Mar. 31, 2004 (JP) ..... 2004-107848

(51) Int. Cl.
*B41J 2/05* (2006.01)

(52) U.S. Cl. ..... 347/65; 347/85; 347/89; 347/40

(58) Field of Classification Search ..... 347/38–72, 347/85, 89, 94
See application file for complete search history.

(56) References Cited

U.S. PATENT DOCUMENTS 5,481,284 A * 1/1996 Kitahara et al. ..... 347/42
5,771,052 A * 6/1998 Hine et al. ..... 347/42
5,801,736 A * 9/1998 Ikkatai et al. ..... 347/86
5,975,681 A 11/1999 Ogasawara et al.
6,561,608 B1 * 5/2003 Yamamoto et al. ..... 347/15
2002/0135638 A1 9/2002 Okuda
2003/0085307 A1 * 5/2003 Okuda et al. ..... 239/548
2003/0098901 A1 * 5/2003 Okuda ..... 347/68

FOREIGN PATENT DOCUMENTS

JP 6-183029 A 7/1994
JP 8-132640 A 5/1996
JP 9-226142 A 9/1997
JP 9-286098 A 11/1997
JP 2002-283585 A 10/2002
JP 2002-361867 A 12/2002

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The liquid droplet discharge head comprises: a plurality of liquid chambers formed with nozzles which discharge droplets of liquid, the plurality of liquid chambers being arranged two-dimensionally; a plurality of liquid pressure application devices each of which causes the droplet of the liquid of a prescribed volume to be discharged from a corresponding one of the nozzles; at least two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the at least two main flow channels has the flow channel ports formed at both end sections thereof, and the plurality of branch flow channels span respectively between the at least two main flow channels.

18 Claims, 14 Drawing Sheets

FIG.13

| | LOW DUTY PROCESSING | CONTINUOUS PROCESSING (PARTIAL PRINTING) | CONTINUOUS PROCESSING (FULL PAGE PRINTING) |
|---|---|---|---|
| STARTUP MODE | YES | YES | YES |
| DROPLET DISCHARGE MODE | YES | YES | YES |
| STANDBY MODE | YES | NO | NO |
| RESTORING MODE | YES | YES | NO |

LIQUID DROPLET DISCHARGE HEAD AND LIQUID DROPLET DISCHARGE DEVICE

BACKGROUND OF THE INVENTION

1. Field of the Invention

The present invention relates to a liquid droplet discharge head and a liquid droplet discharge device, and more particularly, to a liquid droplet discharge head and a liquid droplet discharge device which applies liquid droplets onto an object by discharging liquid from nozzles.

2. Description of the Related Art

A known example of a liquid droplet discharge head and a liquid droplet discharge device using same is an inkjet printer equipped with a recording head formed with a plurality of nozzles which discharge ink.

An inkjet printer discharges ink from nozzles of pressure chambers by means of the pressure generated when the pressure chambers of the recording head are deformed mechanically, or when air bubbles are formed by switching on a heater disposed in the ink flow channel, the discharged ink being applied to an object (recording medium), such as recording paper. The recording head and the recording medium are moved relatively to each other, thereby forming a desired image on the recording medium. Therefore, the quality of the image formed is largely dependent on the performance of the recording head provided in the printer.

However, air bubbles may become trapped inside the recording head when ink is first filled into the head, and air bubbles may also enter into the ink flow channels via the nozzles, due to the pulsating action generated in the ink. Air bubbles of this kind impede the supply of ink and absorb the pressure created in order to discharge the ink, and consequently, they may lead to ink discharge errors in the nozzles, such as defects in the ink discharge volume (the dot size ejected onto the recording medium), the flight direction (droplet ejection position), the flight velocity (droplet ejection position), and the like. Such errors can cause the quality of the recorded image to decline.

In order to resolve these problems, there are commonly known technologies which expel air bubbles by performing restoring processes (flushing, wiping, preliminary discharge, nozzle suction, and the like) in the recording head as and when necessary. Furthermore, inventions have been disclosed which seek to improve air bubble expulsion characteristics, and to improve the stability of ink discharge from the nozzles during image formation (see Japanese Patent Application Publication Nos. 9-226142, 2002-283585, 2002-361867 and 8-132640).

Japanese Patent Application Publication No. 9-226142, for example, discloses that ink flow speed in the ink supply section is accelerated and air bubble expulsion properties are improved by making the cross-sectional area of the ink supply section to the pressure chambers smaller than the cross-sectional area of the common liquid chamber (which is provided on the upstream side of the pressure chambers).

Japanese Patent Application Publication No. 2002-283585 discloses an ink supply shape for a matrix type recording head having good stability at high speed, and it also states that the stability of continuous, high-speed ink discharge is improved by setting numerical limits on the flow channel resistance of the ink supply section.

In Japanese Patent Application Publication No. 2002-361867, ink supply ports (the liquid supply devices described in Japanese Patent Application Publication No. 2002-361867) are provided in the center and at either end of the main flow path of a matrix-type recording head, whereby the flow channel resistance is reduced and the recording head is made more compact in size.

Japanese Patent Application Publication No. 8-132640 discloses improvement in the stability of continuous, high-speed ink discharge by seeking to reduce the pulsating action of a pump by adopting a circulatory ink supply by means of buffer tanks.

Furthermore, Japanese Patent Application Publication No. 9-286098 discloses a line type head having ink supply ports provided at either end of the lengthwise direction of a recording head.

Japanese Patent Application Publication Nos. 9-226142 and 2002-283585 disclose technology for improving the expulsion of air bubbles during nozzle suctioning, by increasing the flow speed in the ink supply channel and providing dummy nozzles. However, since the ink supply channel has end sections, air bubbles are liable to collect in these end sections and hence there is a problem in that air bubbles are not expelled satisfactorily. In nozzle suction performed in order to expel air bubbles trapped in end sections such as these, it is necessary to suction a large amount of ink. In particular, when technology of this kind is used in a long recording head, it is necessary to suction an even greater quantity of ink.

Japanese Patent Application Publication No. 2002-361867 discloses technology which reduces the flow channel resistance by providing ink supply ports in the center or the respective ends of the main flow path, but since only one or two ink supply ports are provided, a problem arises in that ink supply deficiencies become more liable to occur, the larger the size of the recording head, for instance, in a line type inkjet head. Furthermore, since the ink supply channel has end sections, similarly to the prior art, air bubbles are not expelled in a satisfactory manner.

In the technology described in Japanese Patent Application Publication No. 8-132640, various ink supply modes are disclosed in a line type recording head, such as a sub-tank refill mode, discharge refill mode, discharge restoration mode, pressurized discharge restoration mode, and the like. However, there is no description regarding the structure of the internal flow channels of the head and neither is there any description regarding application to a matrix type recording head.

Japanese Patent Application Publication No. 9-286098 discloses a recording head having ink supply ports in the respective end sections of the recording head in the lengthwise direction thereof, but it does not provide a specific description of the ink supply. Furthermore, in a recording head of this kind, it is difficult to achieve stable ink supply in a large matrix type recording head of long dimensions.

SUMMARY OF THE INVENTION

The present invention has been contrived in view of the aforementioned circumstances, and an object thereof is to provide a liquid droplet discharge head which improves the expulsion of air bubbles inside the liquid flow channels of a matrix type head in particular, and to provide a liquid droplet discharge device which achieves improvements in the stability of ink supply and liquid droplet discharge.

In order to attain the aforementioned object, the present invention is directed to a liquid droplet discharge head, comprising: a plurality of liquid chambers formed with nozzles which discharge droplets of liquid, the plurality of liquid chambers being arranged two-dimensionally; a plurality of liquid pressure application devices each of which causes the droplet of the liquid of a prescribed volume to be discharged from a corresponding one of the nozzles; at least two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the at least two main flow channels has the flow channel ports formed at both end sections thereof, and the plurality of branch flow channels span respectively between the at least two main flow channels.

According to the present invention, if the flow channel ports are made to function as liquid supply ports, for example, then since the flow channel ports are formed at the respective ends of the main flow channels, it is possible to supply liquid from all of the ends of the main flow channels, and hence liquid can be supplied stably during a continuous high-speed liquid discharge operation. Thereby, if the present invention is applied to a large liquid droplet discharge head, such as a long recording head, then liquid can be supplied stably without any deficiencies in the liquid supply. Furthermore, if the flow channel ports are made to function as liquid output ports, then since the flow channel ports are formed at the respective ends of the main flow channel, liquid can be expelled smoothly from all of the ends of the main flow channels.

The main flow channels of this kind are not limited to being two in number, and more than two main flow channels may be provided. In this case, flow channel ports may be formed at either end of each of the respective main flow channels, or they may be formed at either end of at least two of a plurality of main flow channels.

Here, liquid is supplied to the main flow channels by a liquid supply device, via the flow channel ports provided at either end of the main flow channels. In the present specification, a "liquid supply device" covers a broad range of devices which supply liquid to the liquid droplet discharge head. More specifically, for example, this term refers broadly to all types of device capable of supplying liquid; not only to a system of liquid piping in a mode where liquid is supplied compulsorily to liquid piping from a liquid tank, or the like, by means of a pump, or the like, but also to a pump in a mode where a pump is connected directly without using liquid piping of this kind.

Preferably, no end sections are formed in flow paths of the main flow channels and the branch flow channels. According to the present invention, since no end sections are formed in the flow path of the main flow channels and the branch flow channels, there is no stagnation of the liquid and hence air bubbles can be removed efficiently. Furthermore, since two main flow channels are provided and a plurality of branch flow channels span between these main flow channels, it is possible to eliminate end sections which impede the circular flow of liquid through the branch flow channels. Therefore, stagnation of the liquid does not occur and air bubbles can be removed efficiently by means of a restoring process.

An "end section" refers to a corner section of the flow channel, where the liquid does not circulate and is liable to stagnate. A specific example is a dead end in the flow channel.

In order to attain the aforementioned object, the present invention is also directed to a liquid droplet discharge device, comprising: a liquid droplet discharge head which comprises: a plurality of liquid chambers formed with nozzles which discharge droplets of liquid, the plurality of liquid chambers being arranged two-dimensionally; a plurality of liquid pressure application devices each of which causes the droplet of the liquid of a prescribed volume to be discharged from a corresponding one of the nozzles; two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the two main flow channels has the flow channel ports formed at both end sections thereof; a first valve device provided on an end of a first main flow channel of the two main flow channels, the first valve device opening and closing a flow of the liquid through the flow channel port; a second valve device provided at an end of a second main flow channel of the two main flow channels on a side opposing to the end of the first main flow channel at which the first valve device is provided, the second valve device opening and closing a flow of the liquid through the flow channel port; and a valve control device which controls the first valve device and the second valve device in accordance with operational modes.

According to the present invention, if the flow channel ports are made to function as liquid supply ports, for example, then since the flow channel ports are formed at the respective ends of the two main flow channels, it is possible to supply liquid from all of the ends of the main flow channels, and hence liquid can be supplied stably during a continuous high-speed liquid discharge operation. Thereby, if the present invention is applied to a liquid droplet discharge device having a large liquid droplet discharge head, such as a long recording head, then liquid can be supplied stably without any deficiencies in the liquid supply. Furthermore, if the flow channel ports are made to function as liquid output ports, then since the flow channel ports are formed at the respective ends of the main flow channel, liquid can be expelled smoothly from all of the ends of the main flow channels.

Since two main flow channels are provided, and a first valve device is provided at one end of a first main flow channel of these main flow channels, while a second valve device is provided at the end of the second main flow channel on the opposite side to the position of the first valve device in the first main flow channel, then it is possible to control the flow of liquid inside the flow channel efficiently, by means of a small number of valve devices. Furthermore, since these valve devices are controlled in accordance with the operating mode, a stabilized liquid supply can be achieved during liquid refilling, a restoring operation, a liquid discharge operation, and the like.

If the plurality of branch flow channels are spanned between the two main flow channels, thereby connecting the main flow channels together, it is possible to eliminate end sections which impede the circular flow of the liquid in the branch flow sections. Therefore, stagnation of the liquid does not occur and air bubbles can be removed efficiently by means of a restoring process.

Preferably, the operational modes include at least two of a startup mode, a liquid droplet discharge mode, a standby mode and a restoration mode. Thus, the flow of liquid can be controlled in accordance with the state of the device and a stable ink discharge operation can be achieved at all times.

Preferably, the valve control device performs, in the startup mode, at least one of a step of closing the first valve device and opening the second valve device, and a step of opening the first valve device and closing the second valve device. Thus, the liquid in the first main flow channel and the second main flow channel can be filled and replaced efficiently.

Preferably, the valve control device performs, in the startup mode, a step of closing both the first valve device and the second valve device. Thus, the liquid in the first main flow channel, the second main flow channel and the branch flow channels can be filled and replaced efficiently.

Preferably, the valve control device performs, in the startup mode, a step of performing a preliminary discharge while opening both the first valve device and the second valve device. Thus, refilling during preliminary discharge, in other words, the responsiveness of liquid replenishment, is improved and preliminary discharge can be performed efficiently.

Preferably, the valve control device performs, in the liquid droplet discharge mode, a step of opening both the first valve device and the second valve device. Thus, refilling characteristics when a liquid droplet has been discharged are improved.

Preferably, the valve control device performs, in the restoration mode, a step of performing a preliminary discharge while opening both the first valve device and the second valve device. Thus, refilling during preliminary discharge, in other words, the responsiveness of liquid replenishment, is improved and preliminary discharge can be performed efficiently.

Preferably, during the preliminary discharge, the liquid is supplied under pressure by a liquid supply device connected to the flow channel ports. Thus, the preliminary discharge capability is increased.

Preferably, the first and second valve devices include valves which regulate the flow of the liquid. Thus, the flow of liquid in the first main flow channel, the second main flow channel and the branch flow channel can be controlled precisely.

Preferably, the main flow channels and the branch flow channels are positioned so as to have substantially rotational symmetry with respect to a center of arrangement of the plurality of liquid chambers. Thus, the effective flow path lengths of the main flow channels and the branch flow channels can be formed so as to be substantially uniform with respect to each of the plurality of liquid chambers, thereby achieving flow channels providing excellent liquid filling, replacement and refilling properties.

The "printing medium" is a medium (an object that may be referred to as an image formation medium, recording medium, recorded medium, image receiving medium, or the like) that receives the printing of the recording head, and includes continuous paper, cut paper, seal paper, resin sheets such as sheets used for overhead projectors (OHP), film, cloth, and various other media without regard to materials or shapes.

According to the present invention, liquid is supplied from all of the ends of the main flow channels, and therefore, liquid can be supplied stably during a continuous, high-speed liquid discharge operation. Furthermore, no end sections are formed in the main flow channels or branch flow channels, thus preventing stagnation of the liquid, and therefore air bubbles can be removed efficiently by means of a restoring process. Furthermore, the flow of the liquid inside the flow channels can be controlled efficiently, in accordance with filling/replacement of the liquid, refilling, and preliminary discharge, by means of a small number of valve devices.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 13 is a chart showing an example of processing combinations in respective modes.

DETAILED DESCRIPTION OF THE PREFERRED EMBODIMENTS

Figure 1:
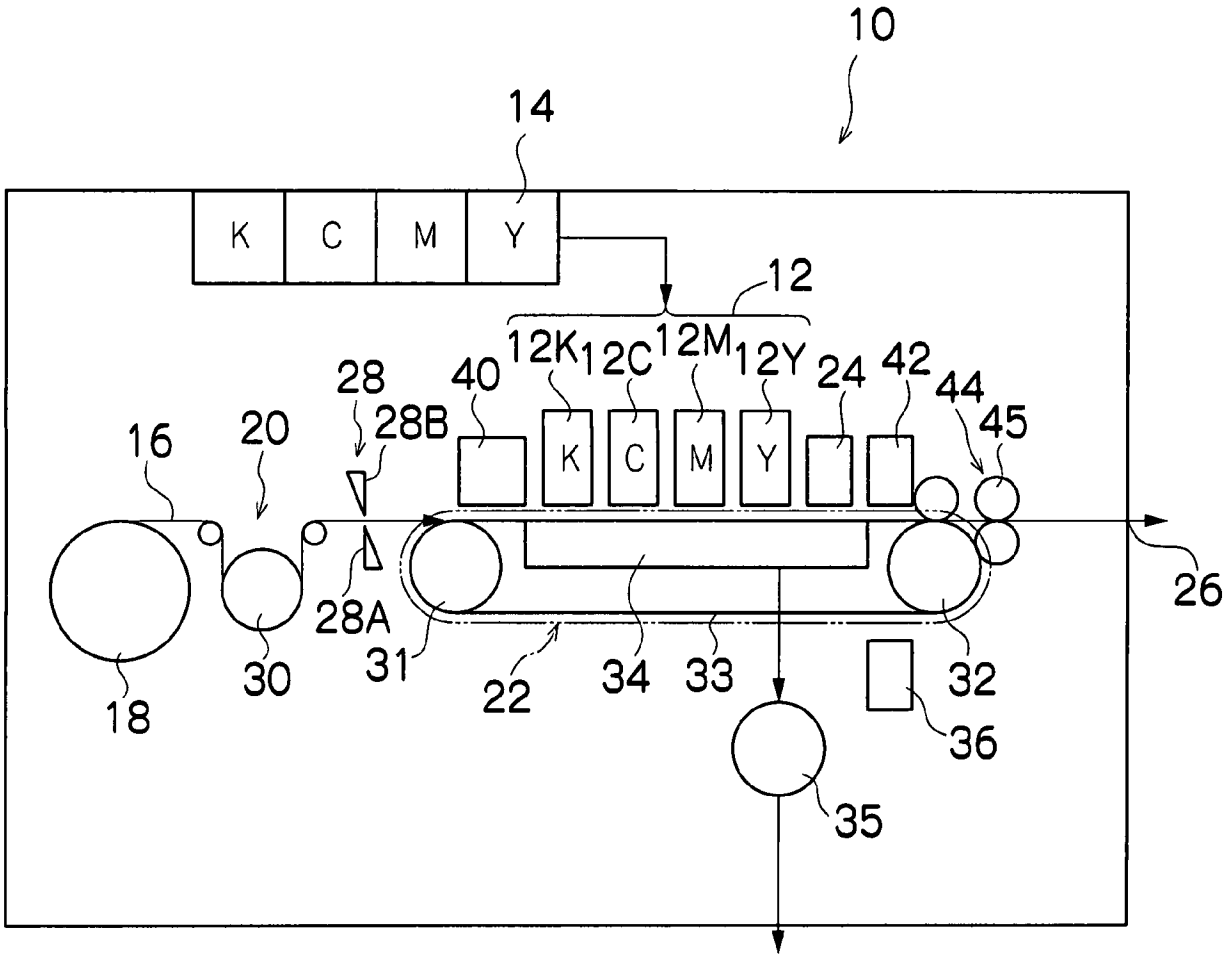
FIG. 1 is a side view showing an inkjet printer to which the liquid droplet discharge head and the liquid droplet discharge device relating to an embodiment of the present invention are applied.
Figure 2:
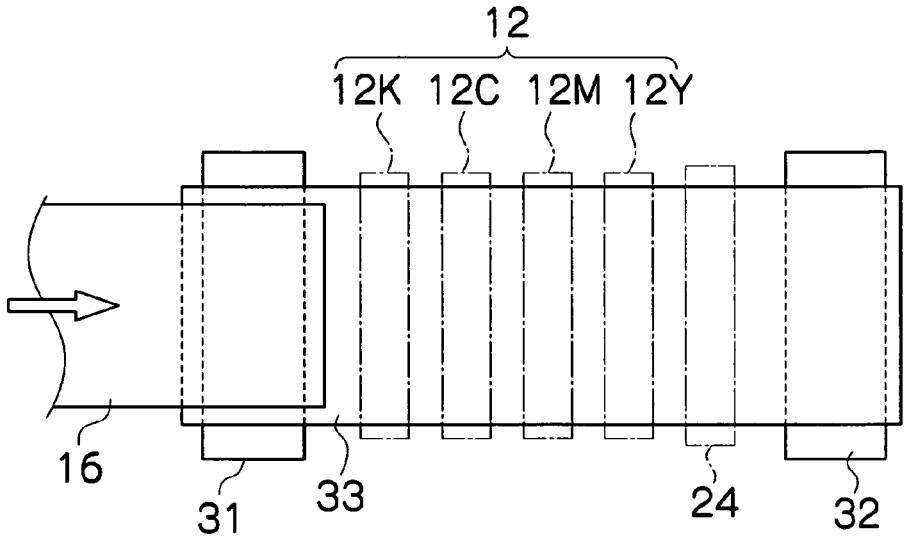
FIG. 2 is a principal plan diagram of the region of an image forming section of an inkjet printer to which the liquid droplet discharge head and the liquid droplet discharge device relating to an embodiment of the present invention are applied.

FIG. 1 is a general schematic drawing of an inkjet printer including a liquid droplet discharge head and a liquid droplet discharge device according to an embodiment of the present invention.

As shown in FIG. 1, the inkjet printer 10 comprises: an image forming unit 12 having a plurality of recording heads 12K, 12C, 12M, and 12Y for ink colors of black (K), cyan (C), magenta (M), and yellow (Y), respectively; an ink storing/loading unit 14 for storing inks to be supplied to the recording heads 12K, 12C, 12M, and 12Y; a paper supply unit 18 for supplying a recording paper 16 (a recording medium); a decurling unit 20 for removing curl in the recording paper 16; a suction belt conveyance unit 22 disposed facing the nozzle face (not shown in FIG. 1, but shown as under surface of a numeral 78 in FIG. 6) of the recording heads 12K, 12C, 12M, and 12Y of the image forming unit 12, for conveying the recording paper 16 while keeping the recording paper 16 flat; an image determination unit 24 for reading the printed result produced by the image forming unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided at the downstream side of the decurling unit 20 as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the image forming unit 12 and the sensor face of the image determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the image determination unit 24 and the nozzle surface of the image forming unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 152 (not shown in FIG. 1, but shown in FIG. 9) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the image forming area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these.

The inkjet printer 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A recording paper determination unit 40 is provided on the upstream side of the image forming unit 12, in the conveyance path of the recording paper formed by the suction belt conveyance unit 22. The recording paper determination unit 40 determines the position of the recording paper 16 before image formation and it supplies a determination signal to a system controller 132 described later with reference to FIG. 9, in order to specify the ink discharge timing during image formation, and the like.

The image forming unit 12 forms a so-called full-line head in which a line head having a length that corresponds to the maximum paper width is disposed in the direction perpendicular to the paper conveyance direction. Although the structure is not described in detail, each of the recording heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet printer 10.

The recording heads 12K, 12C, 12M, and 12Y are arranged in this order from the upstream side along the paper conveyance direction. A color print can be formed on the recording paper 16 by ejecting the inks from the recording heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which recording heads for ejecting light-colored inks such as light cyan and light magenta are added. In addition, the arrangement order of the recording heads 12K, 12C, 12M, and 12Y is not limited to those.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the recording heads 12K, 12C, 12M, and 12Y, and the tanks are connected to the recording heads 12K, 12C, 12M, and 12Y through a main channel (shown as a numeral 69 in FIG. 8), respectively. The ink storing/loading unit 14 has a warning device (e.g., a display device, an alarm sound generator) for warning when the remaining amount of any ink is low, and has a mechanism for preventing loading errors among the colors.

The image determination unit 24 has an image sensor for capturing an image of the ink-droplet deposition result of the image forming unit 12, and functions as a device to check for ejection defects such as clogs of the nozzles in the image forming unit 12 from the ink-droplet deposition results evaluated by the image sensor (line sensor).

The image determination unit 24 of the present embodiment is configured with at least a line sensor having rows of photoelectric transducing elements with a width that is greater than the ink-droplet ejection width (image recording width) of the recording heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements, which are arranged two-dimensionally.

The image determination unit 24 reads a test pattern printed with the recording heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the image determination unit 24. The post-drying unit 42 is a device to dry the printed image surface, and includes a heating fan, for example. It is preferable to avoid contact with the printed surface until the printed ink dries, and a device that blows heated air onto the printed surface is preferable. In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The recording paper 16 on which the image has been formed is outputted from the paper output unit 26.

Next, the structure of the recording heads is described. The recording heads 12K, 12C, 12M and 12Y have the same structure, and a reference numeral 50 is hereinafter designated to any of the recording heads 12K, 12C, 12M and 12Y.

Figure 3A:
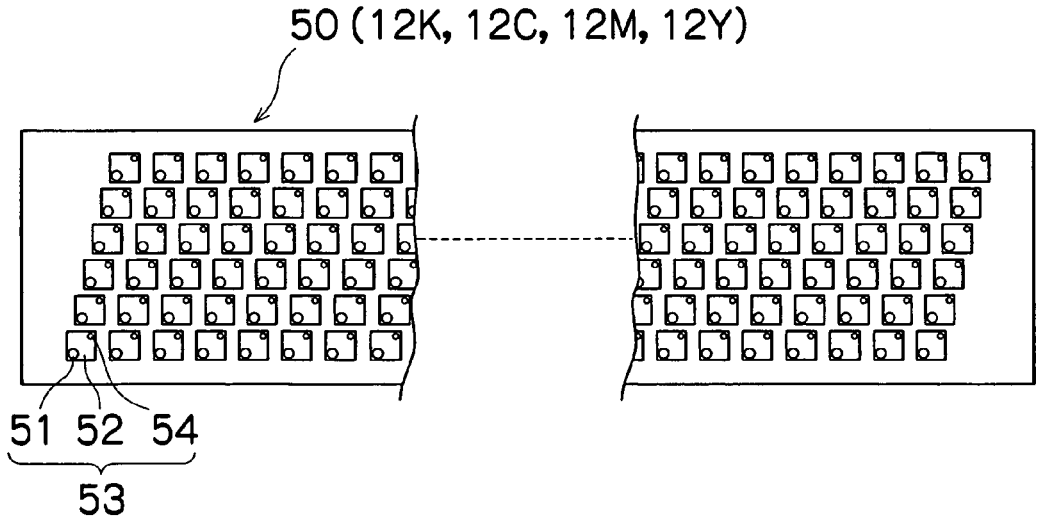
FIGS. 3A and 3B are a plan perspective diagram showing the composition of a recording head forming a liquid droplet discharge head relating to an embodiment of the present invention, and a plan perspective diagram showing a further example of the composition of a full line head.
Figure 3B:
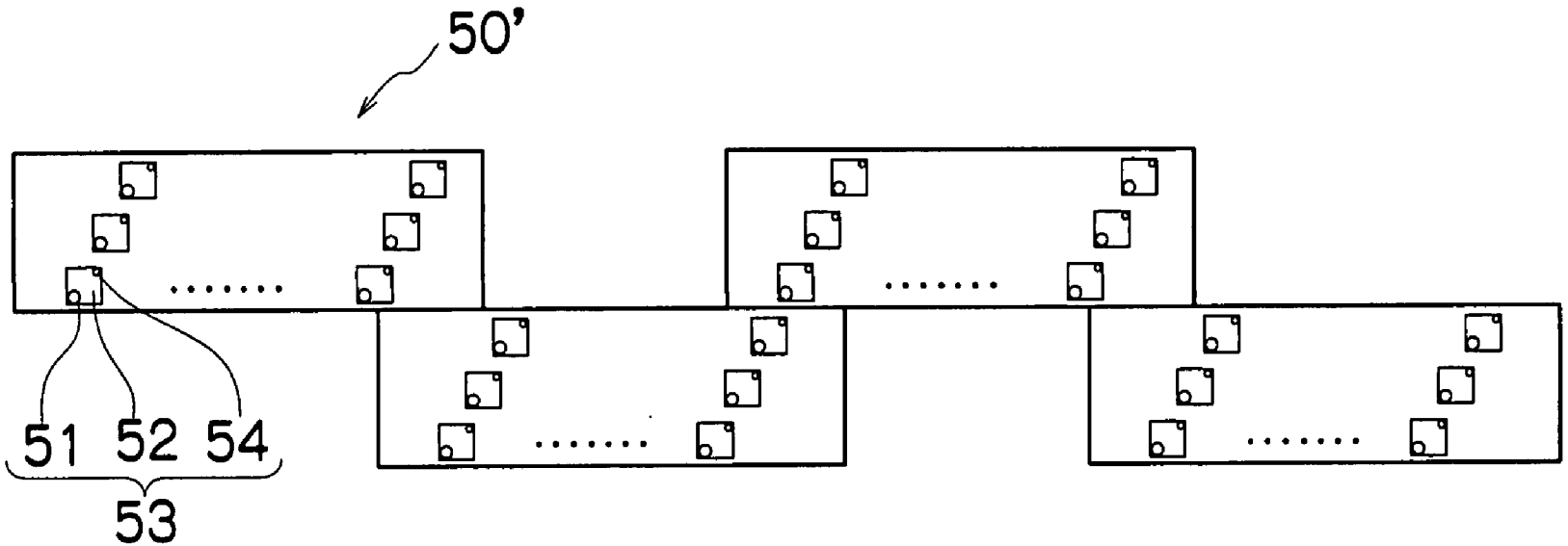

FIG. 3A is a perspective plan view showing an example of the configuration of the recording head 50, and FIG. 3B is a perspective plan view showing another example of the configuration of the recording head. The nozzle pitch in the recording head 50 should be minimized in order to maximize the density of the dots printed on the surface of the recording paper. As shown in FIG. 3A, the recording head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

As shown in FIG. 3A, the recording head 50 in the present embodiment is a full-line head in which one or more of nozzle rows in which the ink ejection nozzles 51 are arranged along a length corresponding to the entire width of the recording medium in the direction substantially perpendicular to the conveyance direction of the recording medium. Alternatively, as shown in FIG. 3B, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and an outlet to the nozzle 51 and an inlet for supplied ink (supply port) 54 are disposed in both corners on a diagonal line of the square. Each pressure chamber 52 is connected to a sub channel (shown as a numeral 62 in FIG. 5) described later through the supply port 54. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

Figure 4:
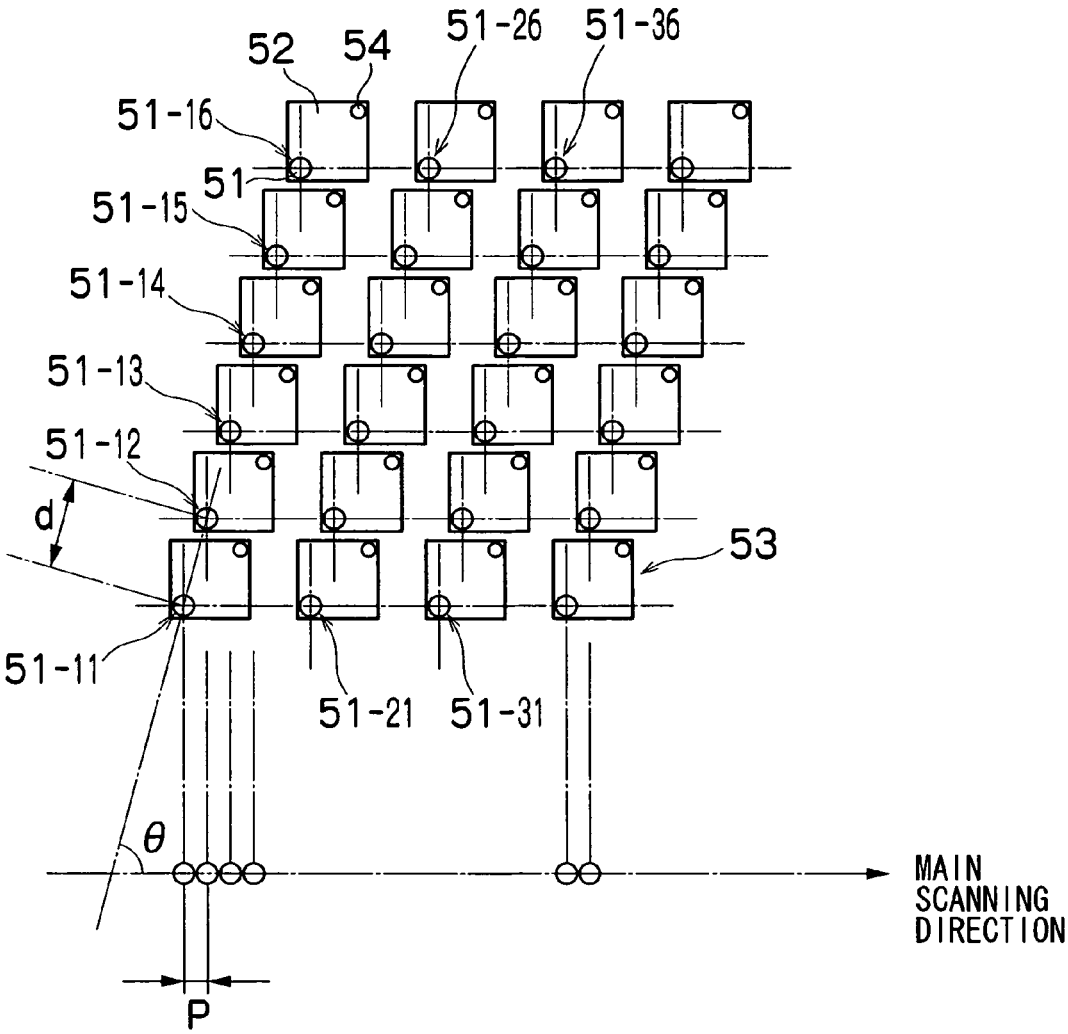
FIG. 4 is an enlarged diagram showing a nozzle arrangement in a recording head which forms a liquid droplet discharge head relating to an embodiment of the present invention.

As shown in FIG. 4, the recording head 50 has a structure in which the plurality of ink chamber units 53 having such a structure are arranged in a grid with a fixed pattern in the line-printing direction along the main scanning direction and in the diagonal-row direction forming a fixed angle $\theta$ that is not a right angle with the main scanning direction. With the structure in which the plurality of rows of ink chamber units 53 are arranged at a fixed pitch d in the direction at the angle $\theta$ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other. In the implementation of the present invention, the structure of the nozzle arrangement is not particularly limited to the examples shown in the drawings.

Figure 5:
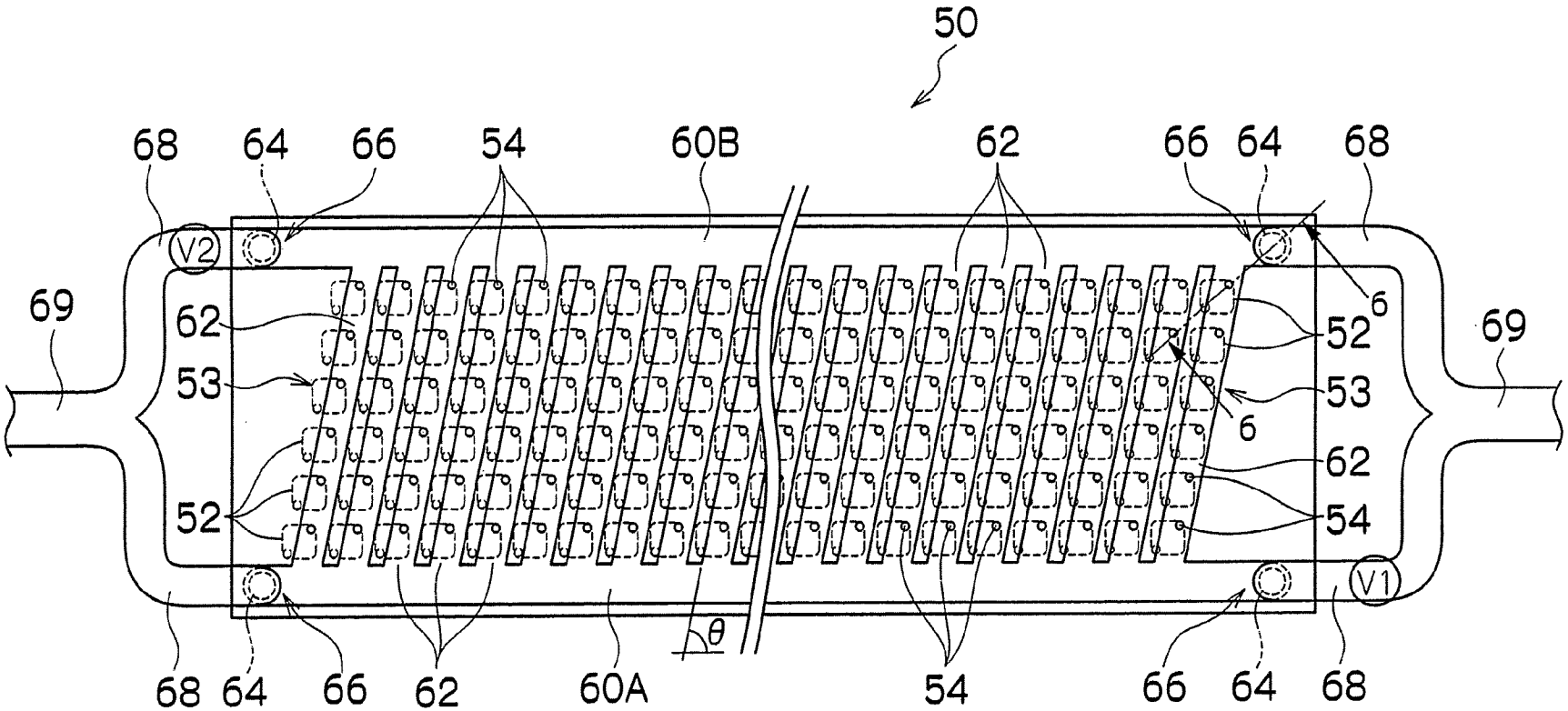
FIG. 5 is a plan perspective diagram showing an ink supply system in a recording head which forms a liquid droplet discharge head relating to an embodiment of the present invention.

As shown in FIG. 5, the recording head 50 comprises an ink supply system including common flow passages 60 (60A and 60B), branch flow channels 62, main supply ports 64, valves V1 and V2, and the like.

The common flow passages 60 are provided in a two-tiered fashion, including an upper and lower row, disposed on either side of the ink chamber units 53 which are arranged in the form of a staggered matrix. The common flow channel 60 on the lower side in the diagram is indicated by reference numeral 60A, and the common flow channel 60 on the upper side is indicated by reference numeral 60B. A main supply port 64 is formed respectively at the left and right-hand end sections 66 of the common flow channels 60A and 60B, and supply pipes 68 for supplying ink are connected to the main supply ports 64.

Valves V1 and V2 are provided in the supply pipes 68. The respective valves V1 and V2 are provided in diagonally symmetrical positions with respect to the print head 50, and in the example relating to the present embodiment, the valves V1 and V2 are provided respectively in the supply pipes 68 on the lower right-hand side and the upper left-hand side in the FIG. 5. The supply pipes 68 converge respectively to form main flow channels 69.

On the other hand, branch flow channels 62 are provided in a plurality of columns in the main scanning direction, to coincide with the columns in which the pressure chambers 52 are arranged at the angle of θ. Therefore, the branch flow channels 62 are disposed in such a manner that they span between the upper and lower common flow channels 60. Furthermore, the branch flow channels 62 are also connected to the supply ports 54 of the respective pressure chambers 52.

Here, as shown in FIG. 5, the common flow channels 60 and the branch flow channels 62 are desirably formed in such a manner that they have approximate rotational symmetry with respect to the central point of the arrangement of ink chamber units 53 disposed in the form of a staggered matrix. In other words, the effective flow path length of the common flow channels 60 and the branch flow channels 62 on the left-hand side from the central position of the arrangement of the group of ink chamber units 53, which is the central point of the recording head 50, is substantially the same as the effective flow path length of the common flow channels 60 and the branch flow channels 62 on the right-hand side, from the same central position. Thereby, it is possible to form flow channels of approximately equal shape on the left-hand side and the right-hand side of the recording head 50, and hence flow channels providing excellent liquid filling/replacement and refilling characteristics can be formed.

By means of an ink supply system having this composition, when ink is supplied from the supply pipes 68, then the ink is supplied to the pressure chambers 52 via the common flow channels 60 and the branch flow channels 62.

Next, the internal structure of the recording head 50 will be described.

Figure 6:
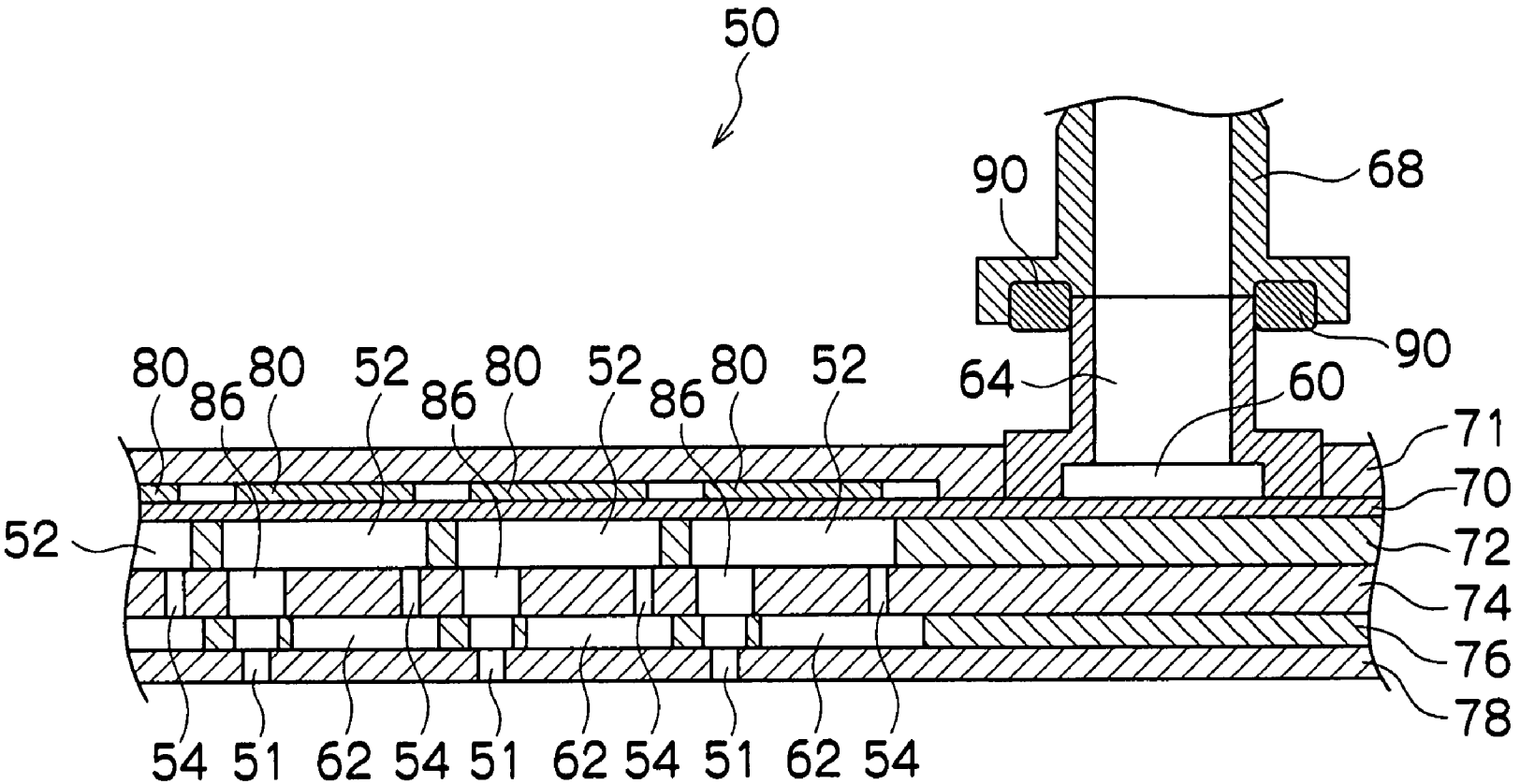
FIG. 6 is a cross-sectional view along line 6-6 in FIG. 5.

FIG. 6 is a vertical cross-sectional diagram of a recording head 50, taken along line 6-6 in FIG. 5 in order to describe the common flow channels 60, the branch flow channels 62 and the main supply ports 64.

As shown in FIG. 6, the recording head 50 has a laminated structure including a diaphragm 70 and a plurality of substrates 71, 72, 74 and 76. Reference numeral 80 is a piezoelectric element (piezo element) forming an actuator.

The diaphragm 70 of the present embodiment is made of an electrically conductive member, which is connected electrically to the lower surface electrode of the piezoelectric element 80 and functions as a common electrode.

Openings for pressure chambers 52 are formed in the substrate 72 and supply ports 54 are formed in the substrate 74 in order to supply ink to the pressure chambers 52 from the branch flow channels 62 which are formed in the substrate 76.

Furthermore, common flow channels 60 are formed in the substrate 71 (only a portion thereof is shown in FIG. 6, since it provides a cross-sectional view along 6-6 in FIG. 5). Although not shown in FIG. 6, holes are pierced through the substrates 70, 72 and 74 at positions corresponding to the positions of the branch flow channels 62 in order to connect the common flow channels 60 formed in the substrate 71 with the branch flow channels 62 formed in the substrate 76. The main supply port 64 is connected to the supply pipe 68, which is a liquid supply device.

The supply pipe 68 and the main supply port 64 are formed to the same internal diameter, and the supply pipe 68 and the main support port 64 are connected in such a manner that there is no displacement between their respective opening sections. Consequently, it is possible to achieve a straight tube shape in the main supply port 64 and the supply tube 68, and hence the ink can flow into the common flow channel 60 without stagnating. The reference numeral 90 is a rubber packing member for preventing ink leakage, which seals the main supply port 64 and the supply pipe 68.

A nozzle plate 78 formed with the aforementioned nozzles 51 is bonded to the lower surface of the substrate 76, and ink discharge openings 86 connecting the nozzles 51 with the pressure chambers 52 are formed in the substrates 74 and 76.

A flexible wiring board (not illustrated) which transmits drive signals for driving and controlling the piezoelectric elements 80 is provided on the upper surface of the piezoelectric elements 80.

As shown in FIG. 5, the common flow channels 60 are connected to the supply pipes 68 at the ends of the channels, and ink is supplied from all of the ends of the common flow channels 60.

Furthermore, there are no end sections, in other words, no flow path dead ends, in the ink supply system comprising the common flow channels 60, the branch flow channels 62, the main supply ports 64, and the like. More specifically, by adopting branch flow channels 62 disposed in such a manner that they span between the upper and lower common flow channels 60, there are no sections forming barriers to the branch flow channels 62. Thereby, a structure is achieved which does not produce stagnation of the ink, and hence the ink is able to flow readily and smoothly without stagnating.

Furthermore, in FIG. 6, since the main supply port 64 and the supply pipe 68 form a straight tube shape, ink can be supplied without altering the direction of flow of the ink. Moreover, since projecting sections which cause stagnation, or the like, are not interposed in the ink flow path, there is no change in the direction of flow of the ink and stagnation of the ink can be prevented. By increasing the width of the common flow channels 60 and the branch flow channels 62 in the lateral direction (in other words, the direction parallel to the nozzle surface of the nozzle plate 78), it is possible to increase the flow rate of the ink per unit time, but at the same time, the recording head 50 increases in size in the lateral direction, and the density of the nozzles 51 declines. Therefore, in order to prevent this, it is preferable that the common flow channels 60 and the branch flow channels 62 are given a broader width in the vertical direction (in other words, the direction perpendicular to the nozzle surface of the nozzle plate 78).

Figure 7:
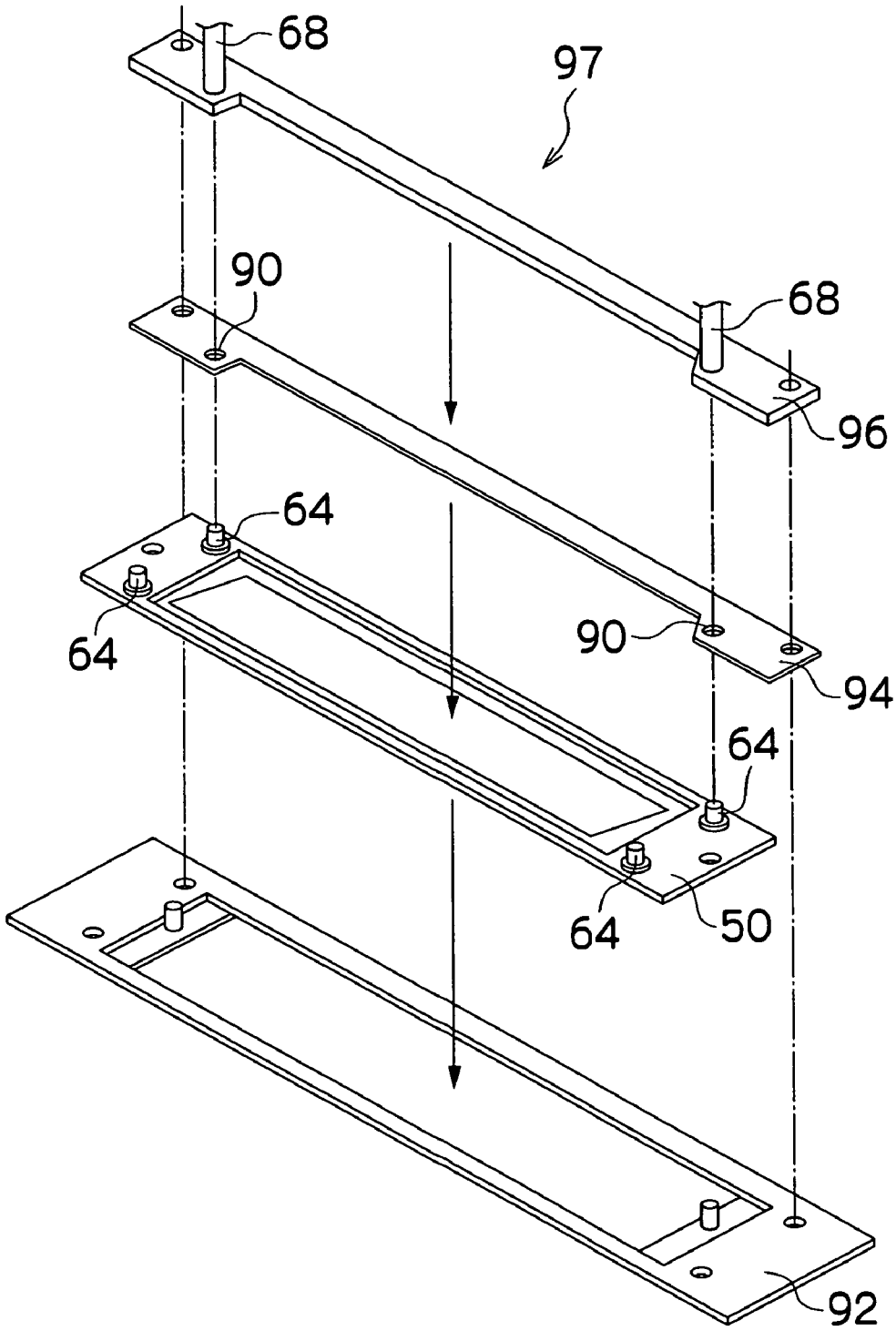
FIG. 7 is an oblique view showing the external composition of a recording head which forms a liquid droplet discharge head relating to an embodiment of the present invention.

In order to install a recording head 50 of this kind in an inkjet printer 10, the head is attached to an independent head block 97 as illustrated in FIG. 7. More specifically, the recording head 50 is fastened to a holder 92 and then held between an attachment 94 and fixed to a coupling plate 96. The supply pipes 68 are provided in the coupling plate 96 and by means of the aforementioned fixing configuration, the supply pipes 68 are connected with the main supply ports 64 in the recording head 50. Although not shown in the drawings, an attachment 94 and a coupling plate 96 are also installed on forehand side in the diagram.

Figure 8:
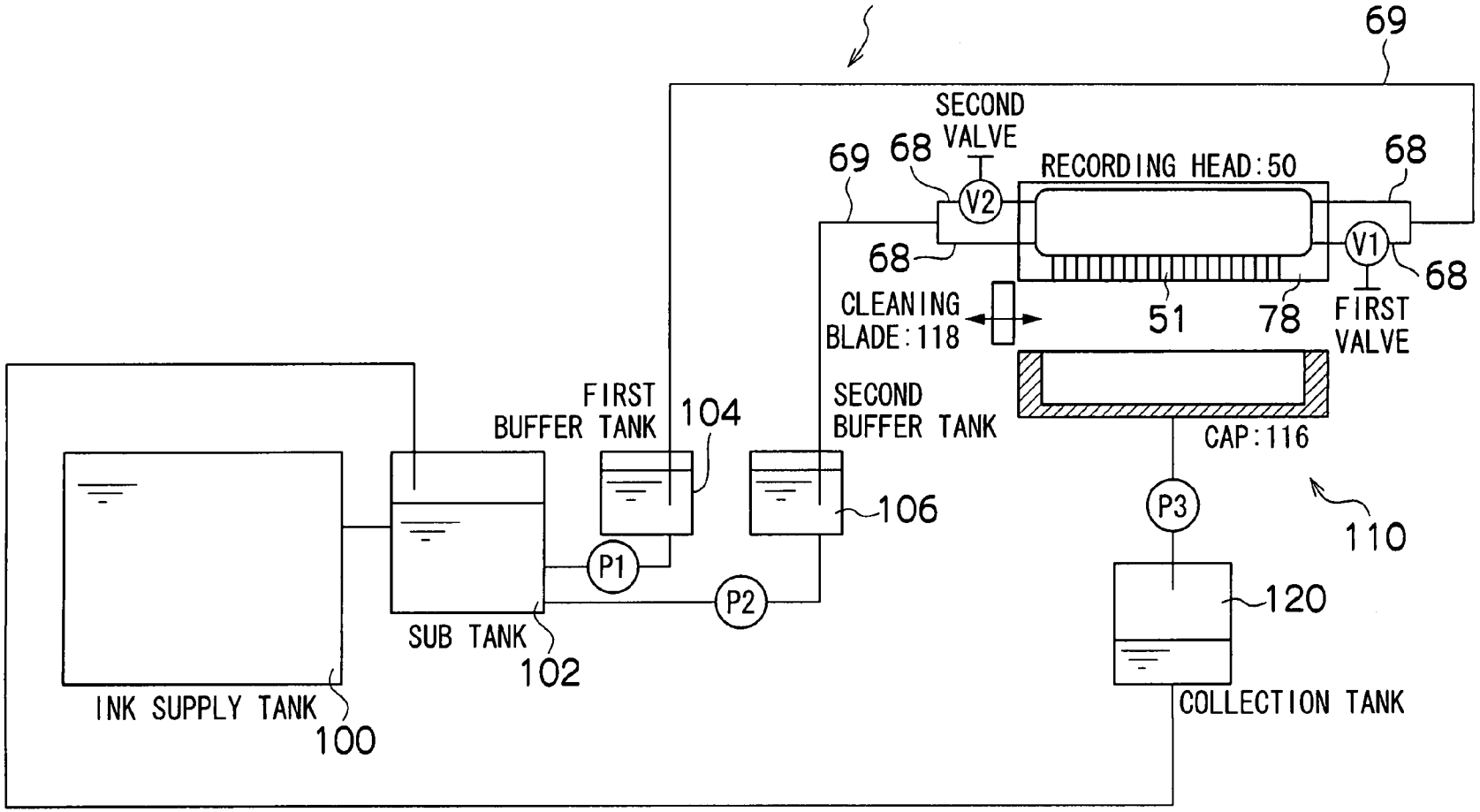
FIG. 8 is a schematic drawing showing an ink supply system of an inkjet printer to which the liquid droplet discharge head and the liquid droplet discharge device relating to an embodiment of the present invention are applied.

FIG. 8 is a conceptual diagram showing the composition of an ink supply system in the main body of an inkjet printer 10. The inkjet printer 10 comprises a sub tank 102, pumps P1 and P2, buffer tanks 104, 106, and the like, provided between an ink supply tank 100 and the recording head 50. Incidentally, reference numeral 110 indicates a maintenance unit of the recording head 50.

The ink supply tank 100 is a base tank that supplies ink and is set in the ink storing and loading unit 14 described with reference to FIG. 1. The aspects of the ink supply tank 100 include a refillable type and a cartridge type: when the remaining amount of ink is low, the ink supply tank 100 of the refillable type is filled with ink through a filling port (not shown) and the ink supply tank 100 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

The sub tank 102 collects ink supplied from the ink supply tank 100 and serves to remove air bubbles in the ink, as far as possible. It is also possible to adopt a composition in which a filter (not illustrated) is provided in order to remove foreign matter and air bubbles, either instead of or in conjunction with the sub tank 102. A sensor (not illustrated) connected by a circuit to the system controller 132 (see FIG. 9) is provided in the sub tank 102, and the presence or absence of ink is determined by the system controller 132. If no remaining ink is determined by the system controller 132, then it is judged that there is no ink left inside the ink supply tank 100.

The buffer tanks 104 and 106 are formed in the vicinity of the recording head 50, or integrally with the recording head 50, between the sub tank 102 and the recording head 50. These buffer tanks absorb the pulsations (internal pressure fluctuations) occurring in the pressure inside the common flow channels 60 and the branch flow channels 62 when the pumps P1 and P2 are driven, and hence they serve to provide a damping effect which maintains the pressure inside the recording head 50 at a suitable uniform value.

The inkjet recording apparatus 10 is also provided with a maintenance unit 110 comprising: a cap 116 as a device to prevent the nozzles 51 from drying out or to prevent an increase in the ink viscosity in the vicinity of the nozzles 51; and a cleaning blade 118 as a device to clean the nozzle face 50A.

The maintenance unit 110 can be relatively moved with respect to the recording head 50 by a movement mechanism (not shown), and is moved from a predetermined holding position to a maintenance position below the recording head 50 as required.

The cap 116 is displaced up and down relatively with respect to the recording head 50 by an elevator mechanism (not shown). When the power of the inkjet recording apparatus 10 is switched OFF or when in a print standby state, the cap 116 is raised to a predetermined elevated position so as to come into close contact with the recording head 50, and the nozzle face 50A is thereby covered with the cap 116.

During printing or standby, when a state in which ink is not ejected from the recording head 50 continues for a certain amount of time or longer, the ink solvent in the vicinity of the nozzles 51 evaporates and ink viscosity increases. In such a state, ink can no longer be ejected from the nozzle 51 even if the piezoelectric element 80 for the ejection driving is operated.

Before reaching such a state the piezoelectric element 80 is operated (in a viscosity range that allows ejection by the operation of the piezoelectric element 80), and the preliminary ejection is made toward the ink receptor to which the ink of which viscosity has increased in the vicinity of the nozzle is to be ejected. The preliminary ejection is also referred to as "dummy ejection", "purge", "liquid ejection", and so on.

Also, when bubbles have become intermixed in the ink inside the recording head 50 (inside the pressure chamber 52), ink can no longer be ejected from the nozzles even if the piezoelectric element 80 is operated. In these cases, the cap 116 is placed on the recording head 50, ink (ink in which bubbles have become intermixed) inside the pressure chamber 52 is removed by suction with a suction pump P3, and the suction-removed ink is sent to a collection tank 120. The suction removed ink is returned to the sub tank 102 according to need. This suction action entails the suctioning of degraded ink of which viscosity has increased (hardened) when initially loaded into the head, or when service has started after a long period of being stopped.

However, this suction action is performed with respect to all the ink in the pressure chamber 52, so that the amount of ink consumption is considerable. Therefore, a preferred aspect is one in which a preliminary ejection is performed when the increase in the viscosity of the ink is small.

The cleaning blade 118 is composed of rubber or another elastic member, and can slide on the ink ejection surface (surface of the nozzle plate) of the recording head 50 by means of a blade movement mechanism (not shown). When ink droplets or foreign matter has adhered to the nozzle plate 78, the under surface of the nozzle plate 78 is wiped, and the under surface of the nozzle plate 78 is cleaned by sliding the cleaning blade 118 on the under surface of the nozzle plate 78. After the nozzle surface is cleaned by a wiper such as the cleaning blade 118 provided as the cleaning device for the nozzle face, a preliminary ejection is also carried out in order to prevent the foreign matter from becoming mixed inside the nozzles 51 by the wiper sliding operation.

Figure 9:
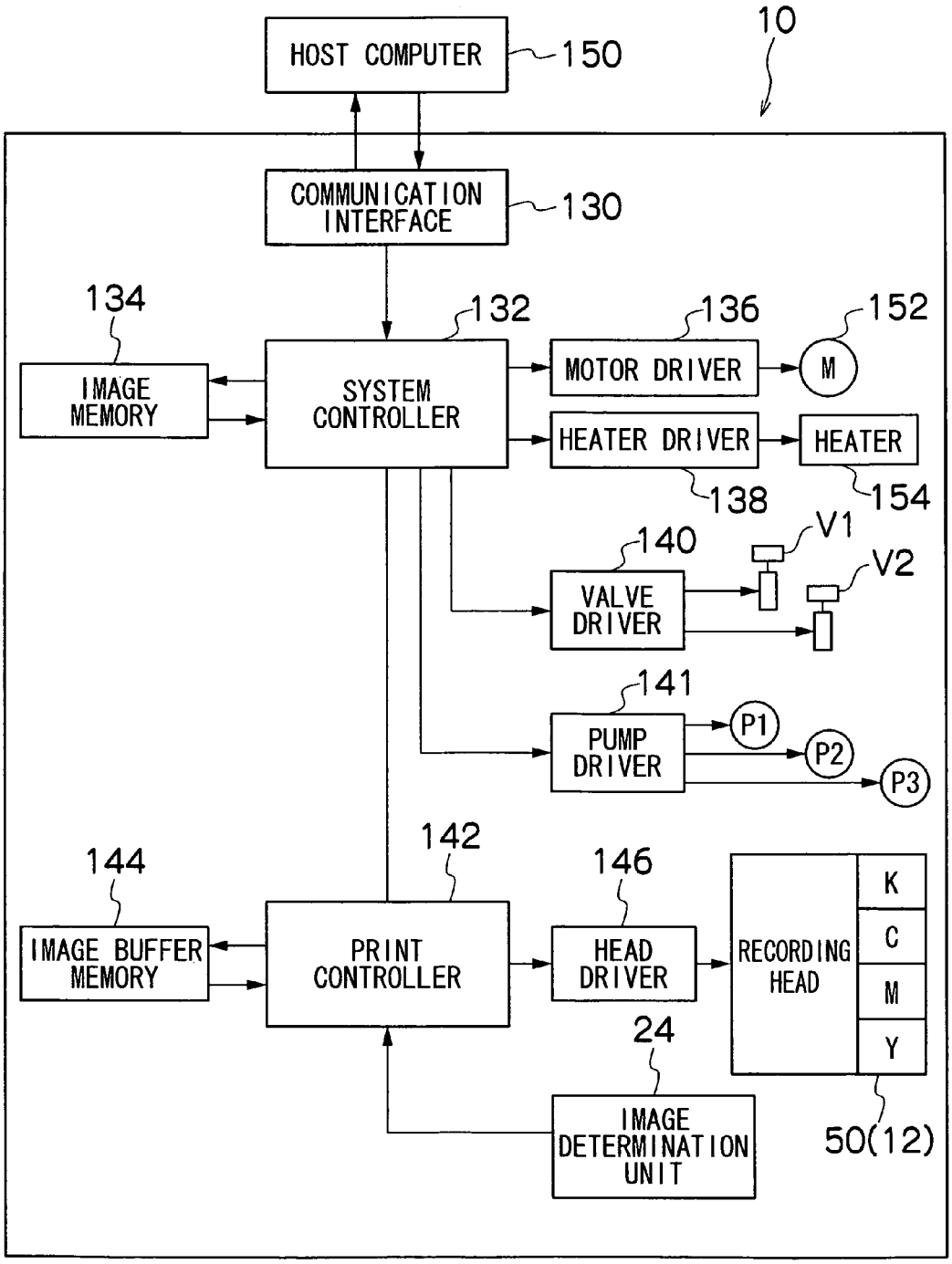
FIG. 9 is a control block diagram of an inkjet printer to which the liquid droplet discharge head and the liquid droplet discharge device relating to an embodiment of the present invention are applied.

FIG. 9 is a block diagram of the principal components showing the system configuration of the inkjet printer 10. The inkjet printer 10 has a communication interface 130, a system controller 132, a memory 134, a motor driver 136, a heater driver 138, a valve driver 140, a pump driver 141, a print controller 142, an image buffer memory 144, a head driver 146, and other components.

The communication interface 130 is an interface unit for receiving image data sent from a host computer 150. A serial interface such as USB, IEEE 1394, Ethernet, wireless network, or a parallel interface such as a Centronics interface may be used as the communication interface 130. A buffer memory (not shown) may be mounted in this portion in order to increase the communication speed. The image data sent from the host computer 150 is received by the inkjet printer 10 through the communication interface 130, and is temporarily stored in the memory 134. The memory 134 is a storage device for temporarily storing images inputted through the communication interface 130, and data is written and read to and from the memory 134 through the system controller 132. The memory 134 is not limited to memory composed of a semiconductor element, and a hard disk drive or another magnetic medium may be used.

The system controller 132 functions as a control device for controlling the whole inkjet printer 10 in accordance with a prescribed program, and it also functions as a calculating device for performing various types of calculations. More specifically, the system controller 132 is constituted by a central processing unit (CPU), peripheral circuits relating to same, and the like. The system controller 132 controls respective units, such as the communications interface 130, the memory 134, the motor driver 136, the heater driver 138, and the like, and it also controls communications with the host computer 150 and read and write operations to and from the image memory 134, as well as generating control signals for controlling the conveyance motor 152 and the heater 154.

The motor driver (drive circuit) 136 drives the motor 152, and the heater driver (drive circuit) 138 drives the heater 154 of the post-drying unit 42. The valve driver 140 drives the valves V1 and V2, and the pump driver 141 drives the pumps P1, P2 and P3. These drivers operate in accordance with commands from the system controller 132.

The print control unit 142 is a control unit having a signal processing function for performing various treatment processes, corrections, and the like, in accordance with the control implemented by the system controller 132, in order to generate a signal for controlling printing, from the image data in the image memory 134, and it supplies the print control signal (image data) thus generated to the head driver 146. Prescribed signal processing is carried out in the print control unit 142, and the ejection amount and the ejection timing of the ink droplets from the respective recording heads 50 are controlled via the head driver 146, on the basis of the image data. By this means, prescribed dot size and dot positions can be achieved.

The print controller 142 is provided with the image buffer memory 144; and image data, parameters, and other data are temporarily stored in the image buffer memory 144 when image data is processed in the print controller 142. The aspect shown in FIG. 9 is one in which the image buffer memory 144 accompanies the print controller 142; however, the image memory 134 may also serve as the image buffer memory 144. Also possible is an aspect in which the print controller 142 and the system controller 132 are integrated to form a single processor.

The head driver 146 drives the recording heads 12K, 12C, 12M, and 12Y of each color on the basis of the print data received from the print controller 142. A feedback control system for keeping the drive conditions for the recording heads constant may be included in the head driver 146.

Various control programs are stored in a program storage section (not illustrated), and a control program is read out and executed in accordance with commands from the system controller 132. The program storage section may be a semiconductor memory, such as a ROM or EEPROM, or it may be a magnetic disk, or a memory card or PC card provided with an external interface. Naturally, a plurality of these storage media may also be provided. The program storage section may also be combined with a storage device for storing operational parameters, and the like (not illustrated).

The image determination unit 24 is a block including a line sensor as shown in FIG. 1, which reads in the image formed onto the recording paper 16, performs various signal processing operations, and the like, and determines the image formation status (presence/absence of ejection, variation in droplet ejection, etc.). The image determination unit 24 supplies these determination results to the print controller 142.

The print controller 142 performs various necessary corrections corresponding to the recording head 50, on the basis of the information obtained from the image determination unit 24.

In the example shown in FIG. 1, the image determination unit 24 is provided on the image formation side, the image formation surface is irradiated with a light source (not illustrated), such as a cold cathode fluorescent tube disposed in the vicinity of the line sensor, and the reflected light is read in by an image sensor. However, in implementing the present invention, another composition may be adopted.

Next, the action of the liquid droplet discharge head according to the present invention will be described.

Figure 10:
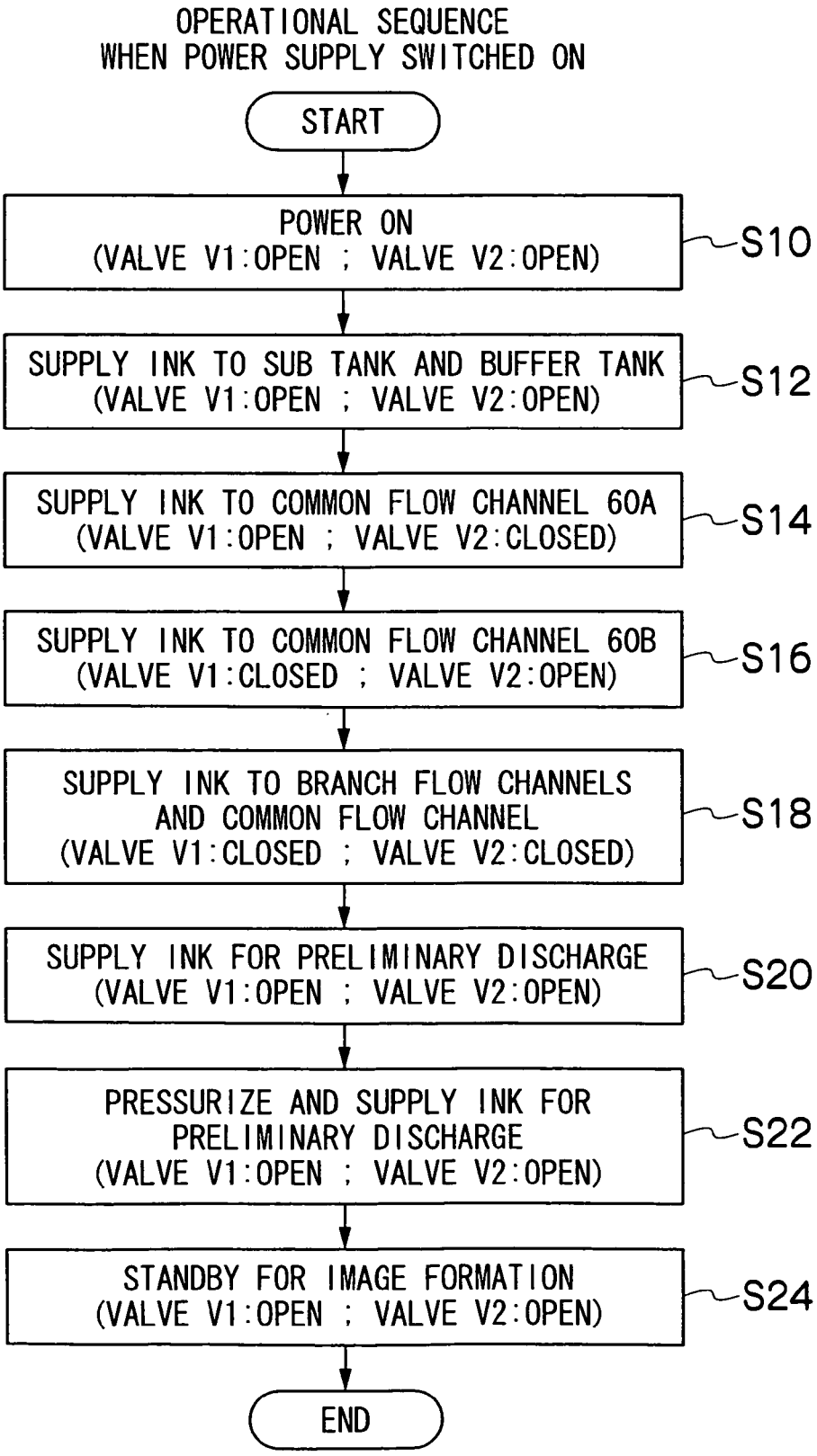
FIG. 10 is a flowchart showing the operational sequence when the power supply is switched on to an inkjet printer to which the liquid droplet discharge head and the liquid droplet discharge device relating to an embodiment of the present invention are applied.

Firstly, the operational sequence when the power supply is switched on to the inkjet printer 10 (namely, the start-up mode) is now described on the basis of FIG. 10, with additional reference to FIG. 5 and FIG. 8.

When the inkjet printer 10 is started up, namely, when the power supply is switched on, the valves V1 and V2 are retained in an opened state (step S10), and in this state, both of the pumps P1 and P2 are driven to supply liquid, in such a manner that ink is filled into the sub tank 102 and the buffer tanks 104 and 106 until the ink levels inside the sub tank 102 and the buffer tanks 104 and 106 reach prescribed levels (step S12). A separate pump (not illustrated) may also be used to refill ink into the sub tank 102.

Thereupon, in order to fill ink reliably into the common flow channel 60A, the valve V2 is closed while the valve V1 is kept open, and the ink is circulated by driving the pump P1 as a liquid propelling pump and driving the pump P2 as a liquid suctioning pump (step S14). When a prescribed time period has elapsed, in order to ensure that ink is filled reliably into the common flow channel 60B, the valve V1 is closed and the valve V2 is opened, whereupon the ink is circulated by driving the pumps in a similar manner to S14 (step S16). By this means, the ink is filled into the common flow channels 60A and 60B and air bubbles are expelled smoothly without performing preliminary discharge. Step S14 and step S16 may also be performed in the reverse sequence.

Moreover, at step S18, the valve V1 or V2 which is currently open is closed, and the ink is circulated by driving the pumps similarly to S16, with both the valves V1 and V2 in a closed state. Thereby, the ink supplied to the common flow channels 60A and 60B is filled into the branch flow channels 62, and air bubbles inside the branch flow channels 62 are expelled smoothly, without performing preliminary discharge.

Thereupon, both of the valves V1 and V2 are opened, and preliminary discharge is performed while circulating the ink by driving the pumps similarly to S118, thus expelling ink containing air bubbles from the nozzles (step S20). Consequently, the ink containing air bubbles in the pressure chambers 52 can be expelled via the nozzles 51. Furthermore, since the valves V1 and V2 are both in an open state during this operation, refilling of the expelled ink can be performed smoothly.

Moreover, in order to ensure that ink containing air bubbles is expelled reliably from inside the common flow channels 60 and the branch flow channels 62, at least one of the pumps P1 and P2 is driven, for instance, by halting the pump P2 while continuing to drive the pump P1 as a liquid propelling pump, in such a manner that the ink is supplied in a pressurized state (step S22). By this means, it is possible to expel the ink containing air bubbles inside the common flow channels 60, the branch flow channels 62 and the pressure chambers 52, reliably, from the nozzles 51. Since the valves V1 and V2 are in an open position, the ink is supplied smoothly to the recording head 50.

After carrying out these processes, the apparatus assumes an image formation standby state (standby mode) at step S24. The pumps P1 and P2 are halted. In addition to step S20, step S22, and the like, described above, in the restoring process described below, the ink expelled from the nozzles 51 is ejected as droplets onto the cap 116 and it is returned to the sub tank 102 via a recovery tank 120.

Here, the action of the recording head 50 upon start-up of the inkjet printer 10 will be described.

In FIG. 5, ink is supplied to the recording head 50 from a supply pipe 68 via a main supply port 64, and ink is filled into the common flow channels 60A and 60B. Thereupon, ink is filled from the common flow channels 60A and 60B into the branch flow channels 62. Since the ink is circulated by means of this ink filling operation, the ink is replenished and renewed in a reliable fashion. Furthermore, ink is filled into the pressure chambers 52 and the nozzles 51, and preliminary discharge is performed from the nozzles 51, thereby allowing ink containing air bubbles to be discharged reliably from the nozzles 51 of the pressure chambers 52.

Figure 11:
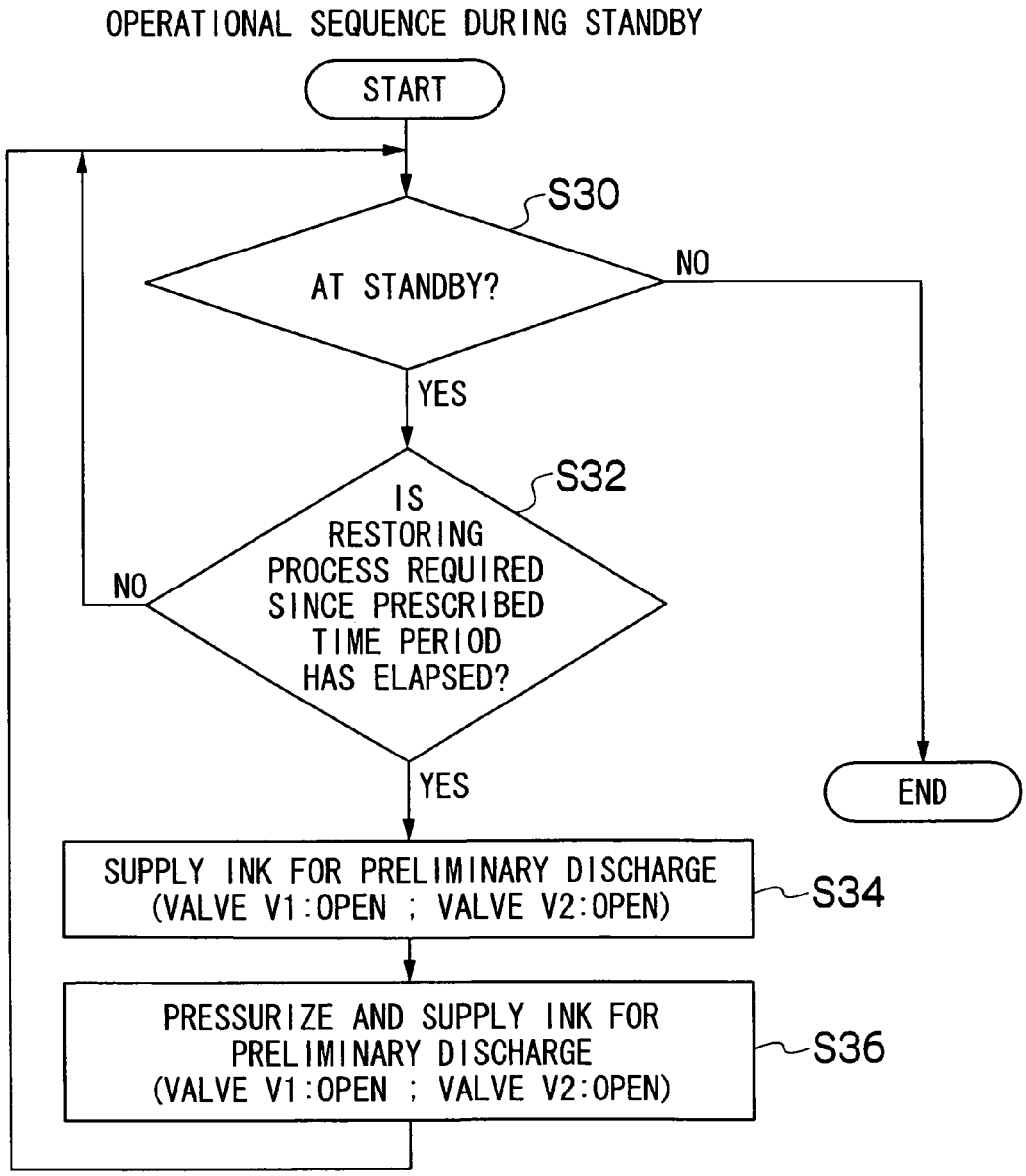
FIG. 11 is a flowchart showing the operational sequence during standby in an inkjet printer to which the liquid droplet discharge head and the liquid droplet discharge device relating to an embodiment of the present invention are applied.

Next, the operational sequence after the image formation standby mode in step S24 of FIG. 10 will be described with reference to FIG. 11.

If it is judged at step S30 that the printer is in image formation standby mode, then the standby time is measured at step S32. If the system controller 132 (see FIG. 9) judges that it is necessary to carry out a restoring process of the recording head 50, because a prescribed standby time has elapsed and the nozzles have continued in a state of not discharging ink for a certain time period or longer, then the procedure advances to step S34, the piezoelectric elements 80 of the recording head 50 are driven while the valves V1 and V2 are kept open, and ink is expelled from the nozzles. Defective ink, such as ink of increased viscosity or ink containing air bubbles, present in the pressure chambers 52 can be expelled via the nozzles 51.

Thereupon, in order to ensure that defective ink is expelled reliably, at least one of the pumps P1 and P2 is driven at step S36, thereby supplying the ink under pressure. Accordingly, the defective ink occurring in the vicinity of the nozzles 51 due to increase in viscosity with the passage of time, and the like, can be expelled reliably. Furthermore, if air bubbles have occurred in the ink, then the ink containing the air bubbles can be expelled. Since the valves V1 and V2 are in an open state, the ink is supplied smoothly. The procedure then returns to step S30.

Next, a liquid droplet discharging mode during image formation will be described.

In FIG. 9, during image formation, the image data to be printed is input from a host computer 150 to the inkjet printer 10 via the communications interface 130, and it is stored in the image memory 134. The system controller 132 drives the motor via the motor driver 136, the recording paper 16 is picked up from the roll paper illustrated in FIG. 1 and it is conveyed to the cutter 28. The system controller 132 causes the recording paper 16 to be cut by the cutter 28 to a previously determined paper size in accordance with the image data, via the print control unit 142, and the cut recording paper 16 is transported to the suction belt conveyance unit 22. Thereupon, the system controller 132 drives the motor 108 via the motor driver 136 and the rollers 31 and 32 are consequently rotated. Therefore, the recording paper 16 is conveyed to the image forming unit 12 by the belt 33. When the recording paper 16 arrives at the image forming unit 12, image formation onto the recording paper 16 is performed by the recording head 50. More specifically, the image data stored in the memory 134 in FIG. 9 is supplied to the print controller 142, and it is converted into data for dots of each ink color, by means of the head driver 146. The head driver 146 reads in this dot data, and generates a drive control signal for the recording head 14.

By supplying the drive control signal generated by the head driver 146 to the recording head 50, ink is discharged from the nozzles 51 onto the image recording surface of the recording paper 16. More specifically, on the basis of the determination results from the recording paper determination unit 40, the system controller 132 controls the ink discharge timing from the recording head 50 in synchronism with the conveyance speed of the recording paper 16, and an image is formed on the recording paper 16 without halting the conveyance of the recording paper 16. After recording, the recording paper 16 is conveyed by the suction belt conveyance unit 22 and is output from the paper output section 26.

In FIG. 6, by applying a drive voltage to the piezoelectric element 80 bonded to the diaphragm 70, the pressure chamber 52 is pressurized by the deformation of the piezoelectric element 80 and ink is discharged downward from the nozzle 51. In this case, as shown in FIG. 8, the ink in the sub tank 102 is supplied to the recording head 50 via the main flow channel 69, due to the pressure difference between the buffer tanks 104, 106 and the pressure chambers 52 (the difference in the liquid levels caused by the ink discharge from the nozzles 51), and this ink passes from the common flow channels 60, along the branch flow channels 62, and into the pressure chambers 52.

In FIG. 5, during image formation, the valves V1 and V2 are open and ink is discharged from the nozzles 51 when the piezoelectric elements 80 in the recording head 50 are driven in this state. The pumps P1 and P2 are not driven. Since the supply pipes are connected to all of the ends of the common flow channels, it is possible to supply ink from all ends of the common flow channels, and therefore, ink can be supplied stably even during a continuous, high-speed ink discharge operation. Moreover, the valves V1 and V2 may be temporarily closed and then reopened in order to ensure that the operation is even more reliable.

Next, a restoration mode for eliminating air bubbles occurring in the ink will be described.

Figure 12:
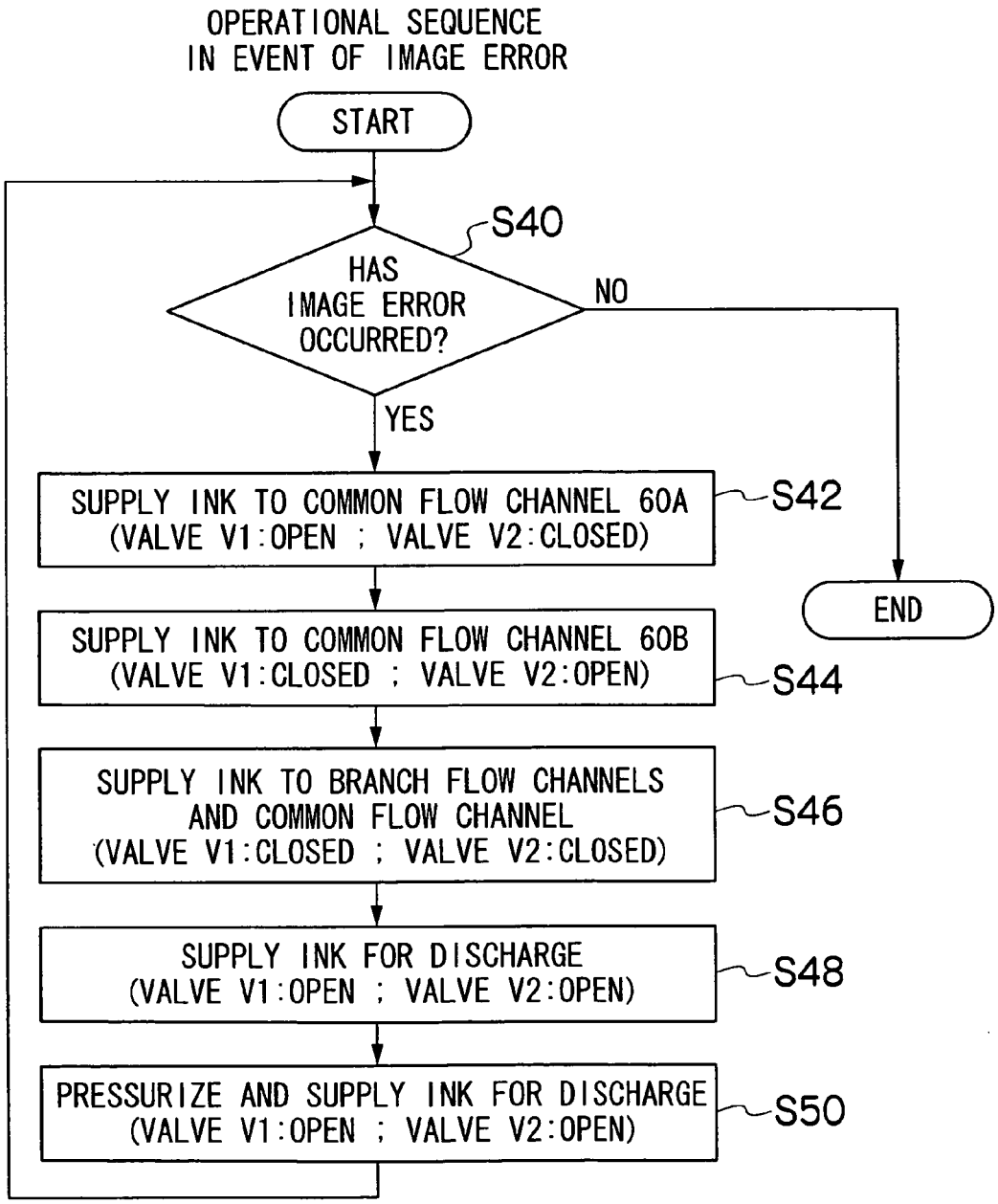
FIG. 12 is a flowchart showing the operational sequence in the event of an image error in an inkjet printer to which the liquid droplet discharge head and the liquid droplet discharge device relating to an embodiment of the present invention are applied.

FIG. 12 shows the operational sequence in a restoration mode in the event of an image error.

At step S40, if an image error has been determined by the image determination unit 24, then the valve V2 is closed again, and ink is refilled into the common flow channel 60A (step S42). Subsequently, ink is filled into the common flow channel 60B by closing valve V1 and opening valve V2 (step S44). Due to this operation, it is possible that air present inside the common flow channels 60A and 60B may enter into the ink in the form of air bubbles. Step S42 and step S44 may also be performed in the reverse sequence.

Moreover, at step S46, the valve V1 or V2 which is currently open is closed, and the ink is circulated by driving pump P1 as a liquid propelling pump and pump P2 as a liquid suctioning pump, with both the valves V1 and V2 in a closed state. Thereby, the ink supplied to the common flow channels 60A and 60B is filled into the branch flow channels 62, and air bubbles inside the branch flow channels 62 are expelled smoothly, without performing preliminary discharge.

Thereafter, both of the valves V1 and V2 are opened, the piezoelectric elements 80 of the recording head 50 are driven, and defective ink containing air bubbles is expelled from the nozzles 51 (step S48).

Furthermore, in order to ensure that defective ink is expelled reliably, at least one of the pumps P1 and P2 is driven, thereby supplying the ink under pressure (step S50). In this operation, the pressure generated in the ink in the common flow channels 60, the branch flow channels 62 and the pressure chambers 52 is greater than the pressure created in the ink by the piezoelectric elements 80 during ink discharge for image formation. Therefore, the ink inside the recording head 50 is expelled via the nozzles 51. By means of this expulsion operation, the defective ink remaining inside the pressure chambers 52 is expelled reliably from the nozzles 51. The procedure then returns to step S40.

In this way, it is possible to remove defective ink efficiently and to prevent accumulation of air bubbles. Therefore, the number of restoring processes can be reduced and decline in operability due to interruption of the image forming operation can be prevented.

A general operational sequence of the apparatus has been described above, but it is also possible to combine various modes, selectively, in accordance with the operating rate, print contents, and other relevant factors. FIG. 13 shows an example of this.

In FIG. 13, desirably, in the case of low-duty processing, the startup mode, liquid droplet discharge mode, standby mode and restoration mode are used, whereas in continuous full-page printing, only startup mode and liquid droplet discharge mode are used.

Figure 14A:
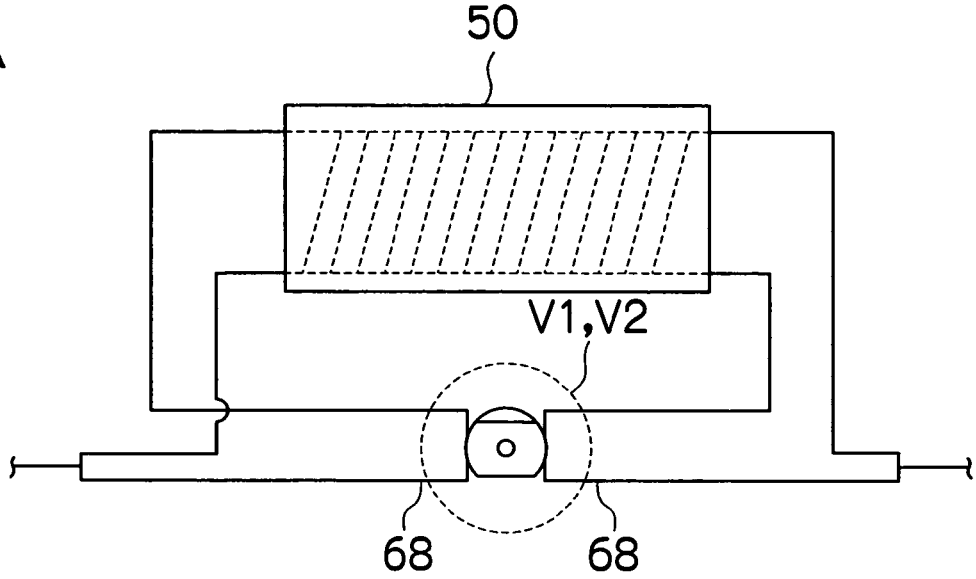
FIGS. 14A to 14C are compositional diagrams showing a desirable valve mechanism used in an inkjet printer to which the liquid droplet discharge head and the liquid droplet discharge device relating to an embodiment of the present invention are applied.
Figure 14B:
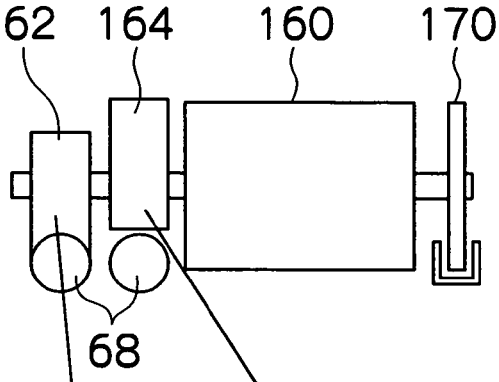

The composition of the valves V1 and V2 described above involves valves of conventional composition disposed in two positions, but it may also be suitable to use valves such as those illustrated in FIGS. 14A and 14B, for instance. The valve mechanism shown in FIGS. 14A and 14B allows the open/close timing of the supply pipe 68 to be switched by means of two cams 162 and 164 of different shapes fixed to the output shaft of a single motor 160.

Figure 14C:
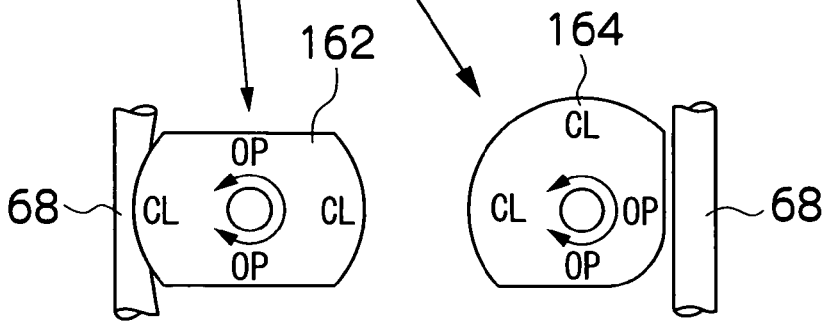

As shown in FIG. 14C, the cams 162 and 164 each have an approximately circular disc shape, one of the cams 162 being cut away on the upper and lower sides, and the other cam 164 being cut away on one of the lateral sides and the lower side. Furthermore, a tube member made of a flexible material such as rubber, or the like, is used for the section of the supply pipe 68 which is pressed by the ends of the cams. By rotating the cams 162 and 164, this tube section can be squeezed by the ends of the cams 162 and 164 (namely, by the portions which have not been cut away). Therefore, if the tube is pressed by a cam, the internal diameter of the tube is reduced and hence the flow rate of the ink can be restricted. The ink flow rate may be restricted when the tube section is pressed, or it may be shut off completely.

FIG. 14C shows a state where the valve V1 is closed and the valve V2 is open, the cams 162 and 164 being depicted in a separated fashion for the purposes of the description. Furthermore, the reference numeral 170 in FIG. 14B indicates an encoder for determining the rotational position of the cams.

By adopting a valve mechanism of this composition, if the motor 160 is driven from the state shown in FIG. 14C and the cams 162 and 164 are rotated in the clockwise direction shown in FIG. 14C, then the valves V1 and V2 can be switched sequentially between an open/closed state (90° rotation from 14B), a closed/closed state (180° rotation from FIG. 14B), and an open/open state (270° rotation). Therefore, by adopting a valve mechanism of this composition, it is possible to control the opening and closing of the two valves by means of one motor, and to switch between four open/close modes.

The composition of the liquid droplet discharge head described in the foregoing embodiment is not limited to the composition of this embodiment. For example, in FIG. 6, it is possible to form the nozzle plate 78 from a light transmitting member of polyimide, for example, in such a manner that light can be transmitted to the interior of the branch flow channels 62, while also providing an optical sensor on the lower surface of the nozzle plate 78 so that the presence of air bubbles in the branch flow channels 62 can be detected by this optical sensor. If the optical sensor detects an air bubble in the branch flow channels 62, then a restoring process is carried out, as described previously. Therefore, since the occurrence of an air bubble inside the branch flow channels 62 can be detected immediately, it is possible to prevent decline in the quality of the recorded image, as well as avoiding unnecessary restoring processes. The common flow channels 60 may also be formed from a light transmitting material, such as acrylic, and an optical sensor for detecting air bubbles in the common flow channels 60 may be provided above the common flow channels 60.

The present embodiment relates to a system where piezoelectric elements are used as actuators for applying a pressure (discharge pressure) to the ink inside the protection circuits, ink droplets being ejected as a result of deformation of the piezoelectric elements. However, the implementation of the present invention is not limited to this, and actuators of another composition may be used, provided that they constitute a discharge pressure application device which applies a discharge pressure to the ink.

Furthermore, the present embodiments have been described with reference to a case where a liquid droplet discharge head is used as a recording head in an inkjet printer, but the present invention may also be applied to an liquid droplet discharge head which forms images, circuit wiring, processing patterns, or the like, by discharging a liquid, such as water, a chemical, resist, or a processing liquid, onto a discharge receiving medium, such as a wafer, a glass substrate, an epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet discharge head, comprising:

a plurality of liquid chambers formed with nozzles which discharge droplets of liquid, the plurality of liquid chambers being arranged two-dimensionally;

a plurality of liquid pressure application devices each of which causes the droplet of the liquid of a prescribed volume to be discharged from a corresponding one of the nozzles;

at least two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the at least two main flow channels has the flow channel ports formed at both end sections thereof, and the plurality of branch flow channels span respectively between the at least two main flow channels, wherein each of said flow channel ports formed at both end sections of the at least two main flow channels function as liquid supply ports.

2. The liquid droplet discharge head as defined in claim 1, wherein no end sections are formed in flow paths of the main flow channels and the branch flow channels.

3. The liquid droplet discharge head as defined in claim 1, wherein the main flow channels and the branch flow channels are positioned so as to have substantially rotational symmetry with respect to a center of arrangement of the plurality of liquid chambers.

4. A liquid droplet discharge device, comprising:

a liquid droplet discharge head which comprises:

a plurality of liquid chambers formed with nozzles which discharge droplets of liquid, the plurality of liquid chambers being arranged two-dimensionally;

a plurality of liquid pressure application devices each of which causes the droplet of the liquid of a prescribed volume to be discharged from a corresponding one of the nozzles;

two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the two main flow channels has the flow channel ports formed at both end sections thereof, wherein each of said flow channel ports formed at both end sections of the at least two main flow channels function as liquid supply ports;

a first valve device provided on an end of a first main flow channel of the two main flow channels, the first valve device opening and closing a flow of the liquid through the flow channel port;

a second valve device provided at an end of a second main flow channel of the two main flow channels on a side opposing to the end of the first main flow channel at which the first valve device is provided, the second valve device opening and closing a flow of the liquid through the flow channel port; and a valve control device which controls the first valve device and the second valve device in accordance with operational modes.

5. The liquid droplet discharge device as defined in claim 4, wherein the operational modes include at least two of a startup mode, a liquid droplet discharge mode, a standby mode and a restoration mode.

6. The liquid droplet discharge device as defined in claim 4, wherein the first and second valve devices include valves which regulate the flow of the liquid.

7. The liquid droplet discharge device as defined in claim 5, wherein the valve control device performs, in the startup mode, at least one of a step of closing the first valve device and opening the second valve device, and a step of opening the first valve device and closing the second valve device.

8. The liquid droplet discharge device as defined in claim 5, wherein the valve control device performs, in the startup mode, a step of closing both the first valve device and the second valve device.

9. The liquid droplet discharge device as defined in claim 5, wherein the valve control device performs, in the startup mode, a step of performing a preliminary discharge while opening both the first valve device and the second valve device.

10. The liquid droplet discharge device as defined in claim 5, wherein the valve control device performs, in the liquid droplet discharge mode, a step of opening both the first valve device and the second valve device.

11. The liquid droplet discharge device as defined in claim 5, wherein the valve control device performs, in the restoration mode, a step of performing a preliminary discharge while opening both the first valve device and the second valve device.

12. The liquid droplet discharge device as defined in claim 9, wherein, during the preliminary discharge, the liquid is supplied under pressure by a liquid supply device connected to the flow channel ports.

13. The liquid droplet discharge device as defined in claim 11, wherein, during the preliminary discharge, the liquid is supplied under pressure by a liquid supply device connected to the flow channel ports.

14. A liquid droplet discharge device, comprising:

a liquid droplet discharge head which comprises:

a plurality of liquid chambers formed with nozzles which discharge droplets of liquid, the plurality of liquid chambers being arranged two-dimensionally;

a plurality of liquid pressure application devices each of which causes the droplet of the liquid of a prescribed volume to be discharged from a corresponding one of the nozzles;

two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the two main flow channels has the flow channel ports formed at both end sections thereof;

a first valve device provided on an end of a first main flow channel of the two main flow channels, the first valve device opening and closing a flow of the liquid through the flow channel port;

a second valve device provided at an end of a second main flow channel of the two main flow channels on a side adjacent to the end that is opposite to the end of the first main flow channel at which the first valve device is provided, the second valve device opening and closing a flow of the liquid through the flow channel port; and a valve control device which controls the first valve device and the second valve device in accordance with operational modes, wherein the operational modes include at least two of a startup mode, a liquid droplet discharge mode, a standby mode and a restoration mode, wherein the valve control device, in the startup mode, closes both the first valve device and the second valve device.

15. The liquid droplet discharge device as defined in claim 14, wherein the valve control device performs, in the startup mode, at least one of a step of closing the first valve device and opening the second valve device, and a step of opening the first valve device and closing the second valve device.

16. The liquid droplet discharge device as defined in claim 15, wherein the valve control device performs, in the startup mode, a step of performing a preliminary discharge while opening both the first valve device and the second valve device.

17. A liquid droplet discharge device, comprising:

a liquid droplet discharge head which comprises:

a plurality of liquid chambers formed with nozzles which discharge droplets of liquid, the plurality of liquid chambers being arranged two-dimensionally;

a plurality of liquid pressure application devices each of which causes the droplet of the liquid of a prescribed volume to be discharged from a corresponding one of the nozzles;

two main flow channels including flow channel ports which function as connection ports forming at least one of a liquid supply port and a liquid output port; and a plurality of branch flow channels which are connected to the main flow channels and to the liquid chambers and which supply the liquid to the liquid chambers, wherein each of the two main flow channels has the flow channel ports formed at both end sections thereof;

a first valve device provided on an end of a first main flow channel of the two main flow channels, the first valve device opening and closing a flow of the liquid through the flow channel port;

a second valve device provided at an end of a second main flow channel of the two main flow channels on a side adjacent to the end that is opposite to the end of the first main flow channel at which the first valve device is provided, the second valve device opening and closing a flow of the liquid through the flow channel port; and a valve control device which controls the first valve device and the second valve device in accordance with operational modes, wherein the operational modes include at least two of a startup mode, a liquid droplet discharge mode, a standby mode and a restoration mode, wherein the valve control device performs, in the startup mode, a preliminary discharge while opening both the first valve device and the second valve device.

18. A liquid droplet discharge device, comprising:

a liquid droplet discharge head which comprises:

a plurality of liquid chambers formed with nozzles which discharge droplets of liquid, the plurality of liquid chambers being arranged two-dimensionally;

a plurality of liquid pressure application devices each of which causes the droplet of the liquid of a prescribed volume to be discharged from a corresponding one of the nozzles;

two main flow channels including flow channel ports which function as connection ports forming at least one of a liquid supply port and a liquid output port; and a plurality of branch flow channels which are arranged so that the plurality of branch flow channels span between the two main flow channels, the plurality of branch flow channels connecting the main flow channels with the liquid chambers and supplying the liquid to the liquid chambers, wherein each of the two main flow channels has the flow channel ports formed at both end sections thereof;

a first valve device which is provided on the flow channel port formed at one of the end sections of a first main flow channel of the two main flow channels, the first valve device opening and closing a flow of the liquid through the flow channel port;

a second valve device which is provided on the flow channel port formed at one of the end sections of a second main flow channel of the two main flow channels on a side opposing to the end of the first main flow channel at which the first valve device is provided, the second valve device opening and closing a flow of the liquid through the flow channel port; and a valve control device which controls the first and the second valve devices, wherein at least one of when a power supply for the liquid droplet discharge device is turned on and when an image error is determined, the valve control device opens the first valve device and closes the second valve device so as to supply the liquid to the first main flow channel through the first valve device to fill the first main flow channel with the liquid, then closes the first valve device and opens the second valve device so as to supply the liquid to the second main flow channel through the second valve device to fill the second main flow channel with the liquid, so that the first and second main flow channels are filled wit the liquid, and then the valve control device closes the first and second valve devices so as to supply the liquid to the first and second main flow channels and the plurality of branch flow channels through the flow channel ports on which the first and second valve devices are not provided, wherein when the nozzles discharge the droplets of the liquid, the valve control device opens the first and second valve devices so as to supply the liquid to the first and second main flow channels through the first and second valve devices.

* * * * *